United States Patent [19]

Sakamoto

[11] 4,254,514

[45] Mar. 10, 1981

[54] ATTACHABLE TOILET BOWL SEAT AND FOOTREST

[76] Inventor: Minoru Sakamoto, 3911 Nioi Pl., Honolulu, Hi. 96816

[21] Appl. No.: 119,362

[22] Filed: Feb. 6, 1980

[51] Int. Cl.[3] ..... A47K 13/00

[52] U.S. Cl. ..... 4/234; 4/237; 4/239

[58] Field of Search ..... 4/661, 234, 237-236, 4/420, 239-240, 421, 254

[56] References Cited

U.S. PATENT DOCUMENTS

| | | | |
|---|---|---|---|
| 559,304 | 4/1896 | Muckenhorn | 4/421 |
| 906,053 | 12/1908 | McAuliffe | 4/237 |
| 1,215,104 | 2/1917 | Bonner | 4/239 |
| 1,737,163 | 11/1929 | Keppinger | 4/239 |
| 2,099,118 | 11/1937 | Kennedy | 4/420 |
| 2,518,272 | 8/1950 | Beckwith | 4/239 |
| 2,698,440 | 1/1955 | Lyons | 4/254 |
| 2,752,610 | 7/1956 | Mabrey | 4/237 |
| 3,171,138 | 3/1965 | Brunelle | 4/237 |
| 3,520,005 | 7/1970 | Downes | 4/234 |
| 3,786,522 | 1/1974 | Kira et al. | 4/237 |
| 4,048,679 | 9/1977 | Garnett | 4/237 |
| 4,145,767 | 3/1979 | Ibel | 4/237 X |
| 4,175,294 | 11/1979 | Boyd | 4/237 |
| 4,207,628 | 6/1980 | Ibel | 4/234 |

*Primary Examiner*—Henry K. Artis
*Attorney, Agent, or Firm*—Harvey B. Jacobson

[57] ABSTRACT

A horizontal seat member defining a central vertical opening therethrough is provided for stationary support from the open upper end of a toilet bowl. The seat member includes front, rear and opposite side portions and defines an upper seat surface which is upwardly concave in a front-to-rear extending direction for more readily conforming to the lower torso configuration of a person having his or her legs bent sharply in positions similar to those assumed when the person is in a squatting position. The forward extremity of the seat member includes a depending portion terminating downwardly in a forwardly and horizontally directed footrest portion for support of the user's feet and the seat member has a hinged cover operatively associated therewith, the cover including first and second sections thereof pivotally joined together along adjacent marginal portions and being swingable between a raised upstanding open position with the cover sections substantially coplanar and a lowered horizontal position with the cover sections relatively oppositely inclined downwardly toward the adjacent marginal edges thereof to more closely conform to the concave seat member. The cover includes structure thereon for releasably retaining the cover sections in the coplanar position thereof.

12 Claims, 5 Drawing Figures

ATTACHABLE TOILET BOWL SEAT AND FOOTREST

BACKGROUND OF THE INVENTION

Various forms of toilet bowl seats heretofore have been provided for assisting a person using the toilet in completing a successful bowel movement. Inasmuch as it is well recognized by the medical field that the ordinary comfortable seating position is not nearly so helpful for a proper movement of the bowels as is a squatting position, several of these previously known attachments are specifically designed to enable the user of the toilet to assume a substantially squatting position while attempting a bowel movement. These previously known forms of attachment include those disclosed in U.S. Pat. Nos. 559,304, 906,053 and 2,099,118. In addition, various other forms of toilet bowl attachments including some of the general structural and operational features of the instant invention are disclosed in U.S. Pat. Nos. 1,215,104, 1,737,163, 2,518,272, 2,698,440, 2,752,610 and 3,171,138. In addition, a squatting position facilitating toilet bowl seat is disclosed in U.S. Pat. Des. No. 233,523.

However, these previously known forms of toilet seats for facilitating the user assuming a squatting position while attempting a bowel movement do not include adequate covers therefor, or if the covers therefor are adequate and of the usual hinged type they interfere with the user of the seat assuming a comfortable squatting position. Accordingly, a need exists for an improved squat position facilitating toilet bowl seat and cover therefor, and with the cover constructed in a manner such that it will substantially cover and close the toilet seat when not in use and not interfere with the assumption of a squatting position by a user when the toilet is in use.

BRIEF DESCRIPTION OF THE INVENTION

The toilet bowl seat of the instant invention defines an upwardly facing seating surface which is concave in a front to rear direction and has a hinged cover operatively associated therewith swingable between a horizontal position closing the seat and an upstanding out-of-the-way open position. However, the cover includes a pair of cover sections which are are pivotally joined together along adjacent marginal portions and are swingable between substantially coplanar positions when the cover is in the open position and inclined positions with the cover sections inclined downwardly toward the adjacent pivotally interconnected marginal edges thereof when the cover is in the closed position in order that the cover may more closely conform to the concave configuration of the upper seat surface. Further, the cover is equipped with structure for releasably retaining the relatively pivotable sections thereof in coplanar positions when the cover is in the open position.

The main object of this invention is to provide a toilet bowl seat which will enable the user to more readily accomplish a bowel movement and which includes an adequate cover for substantially covering and closing the seat when not in use.

Another object of this invention is to provide a toilet bowl seat and cover in accordance with the immediately preceding object and constructed in a manner whereby the cover will not interfere with the user of the seat assuming a squatting position when the toilet is in use and the cover is in the open position.

Another object of this invention is to provide a toilet bowl seat and cover structure in accordance with the preceding objects and which may be releasably attached to an otherwise conventional toilet even though that toilet bowl is equipped with the conventional seat and cover members.

Yet another object of this invention is to provide a combined toilet bowl seat and cover structure including a foot rest for additionally facilitate the user of the seat in assuming a squatting position.

A final object of this invention to be specifically enumerated herein is to provide a toilet bowl seat, footrest and cover construction in accordance with the preceding objects and which will conform to conventional forms of manufacture, be of simple construction and easy to use so as to provide a device that will be economical feasible, long lasting and relatively trouble free in operation.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE INVENTION

Figure 1:
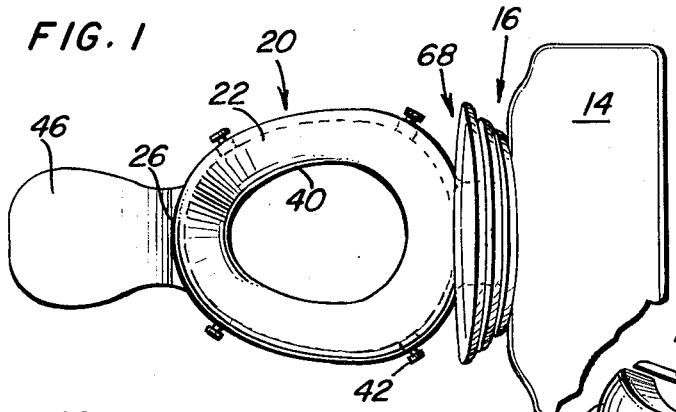
FIG. 1 is a top plan view of the combined seat, footrest and cover structure of the instant invention as applied to a conventional toilet construction.

Referring now more specifically to the drawings, the numeral 10 generally designates a conventional toilet bowl assembly including a bowl member 12, a flush tank 14 operatively associated with the bowl member 12 and a conventional seat and cover assembly referred to in general by the reference numeral 16 and hingedly supported from the bowl member 12 at 18.

The instant invention comprises a supplemental seat assembly referred to in general by the reference numeral 20 usable in conjunction with the toilet bowl assembly 10 and, specifically, the bowl member 12. The assembly 20 includes a horizontal open center seat member 22 defining an upper seat surface 24. The seat member 22 includes front and rear portions 26 and 28 as well as opposite side portions 30 and 32, and the upper seat surface 24 is upwardly concave in a front-to-rear extending direction. Also, the portions of the upper seat surface 24 on opposite sides of the central portion of the front portion 26 of the seat member 22 curve upwardly toward each other as at 34 and 36 and define a rounded front-to-rear extending peak 38 in the central area of the front portion 26 of the seat member 22.

The seat member 22 defines a vertical opening 40 extending therethrough and the undersurface of the seat member 22 about the opening 40 is substantial planar and abuts against the upper surface of the open upper end of the bowl member 12. In addition, peripheral portions of the seat member 22 spaced about the bowl member 12 include depending support lugs 40 equipped with threaded clamp screws 42, whereby the seat member 22 may be clamped in supported engagement with the open upper end of the bowl member 12.

Figure 4:
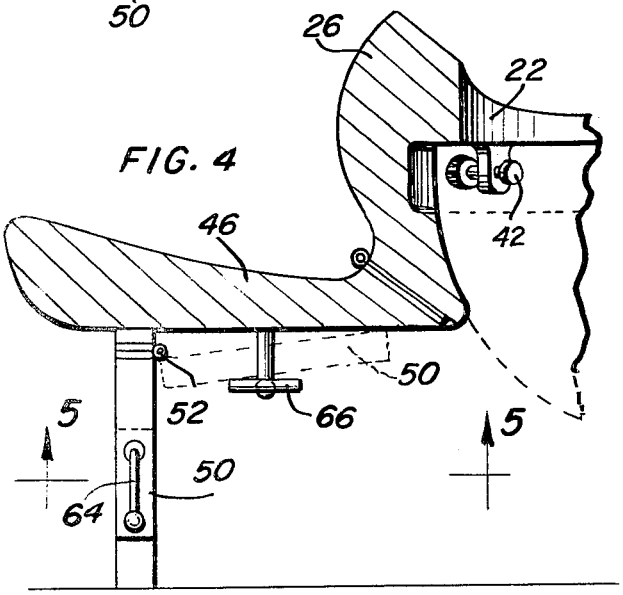
FIG. 4 is an enlarged fragmentary vertical sectional view taken substantially upon the plane indicated by the section line 4—4 of FIG. 3.
Figure 5:
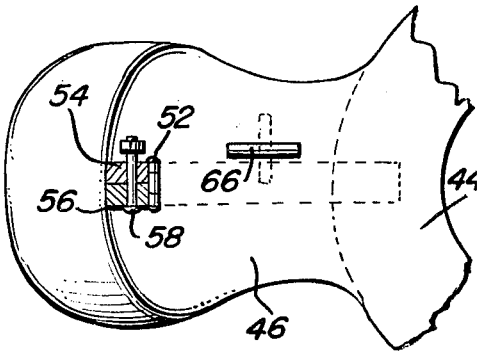
FIG. 5 is an enlarged fragmentary horizontal sectional view taken substantially upon the plane indicated by the section line 5—5 of FIG. 4.

The forward portion 26 of the seat member 22 includes a downwardly directed portion 44 terminating at its lower end in a forwardly directed horizontal footrest portion 46 pivotally supported from the lower end of the depending portion 44 by a hinge 48. The forward end of the footrest portion 46 includes a depending leg assembly 50 pivotally supported from the footrest portion 46 by a hinge assembly 52 and the leg assembly 50 includes a pair of lengthwise overlapped and slotted relatively extendable and retractable leg members 54 and 56 releasably securable in adjusted relatively extended position by clamp screws 58 and 60 threadedly engaged in the leg members 54 and 56 and slidably received in slots 62 and 64 formed in and extending longitudinally of the leg members 56 and 54, respectively. Also, the underside of the footrest portion 46 includes a rotatably supported T-handle 66 which may be utilized to releasably secure the leg assembly 50 in a retracted position thereof such as that indicated by phantom lines in FIG. 4.

The assembly 20 additionally includes a cover referred to in general by the reference numeral 68 and including first and second sections 70 and 72 pivotally joined together by hinge assemblies 74 and 76 spaced along adjacent marginal edge portions of the cover sections 70 and 72. The cover sections 70 and 72 are relatively positionable in coplanar positions such as those illustrated in FIGS. 1, 2 and 3 of the drawings, or in the relatively angulated positions thereof illustrated in FIG. 6 of the drawings wherein the sections 70 and 72 are downwardly inclined toward their adjacent hingedly connected marginal edge portions.

Figure 6:
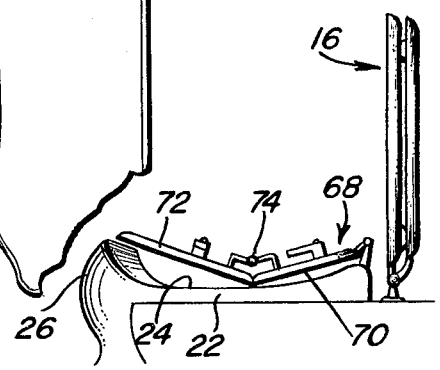
FIG. 6 is a fragmentary side elevational view similarly to FIG. 2 but with the cover portion of the instant invention in a closed position.

When the cover 68 is swung to the horizontal closed position thereof illustrated in FIG. 6 of the drawings with the sections 70 and 72 thereof downwardly inclined toward their adjacent marginal portions, the cover sections 70 and 72 conform, at least generally, to the concavity of the upper surface 24 of the seat member 22. However, when the cover sections 70 and 72 are in the coplanar positions thereof illustrated in FIG. 2 of the drawings, the user 78 of the toilet bowl assembly 10 may assume a squating position without the cover 68 interfering with his squating position as the adjacent marginal edges of the cover sections 70 and 72 would if they remained in the relatively angulated positions thereof illustrated in FIG. 6 when the cover 68 is raised and the toilet bowl assembly 10 is in use.

Figure 2:
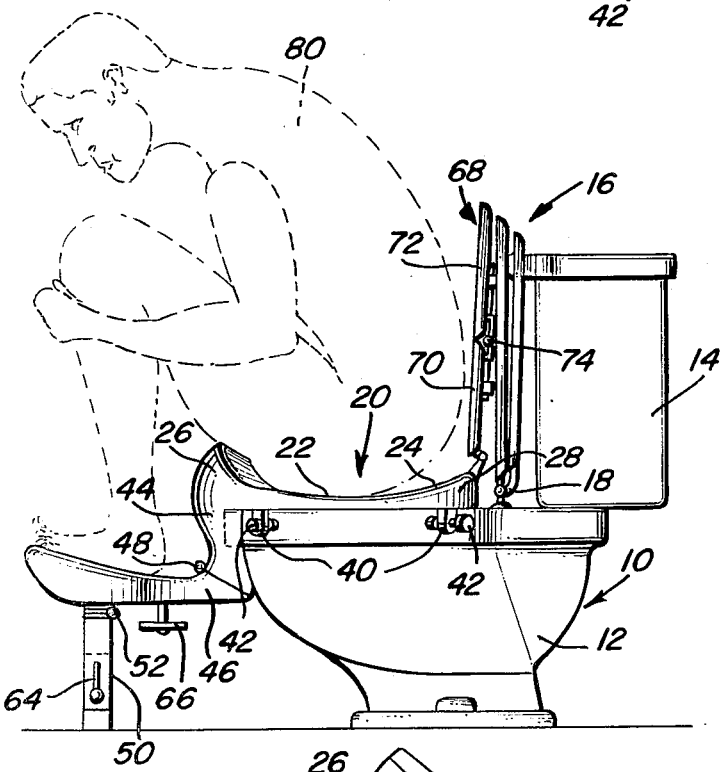
FIG. 2 is a side elevational view of the assemblage illustrated in FIG. 1.
Figure 3:
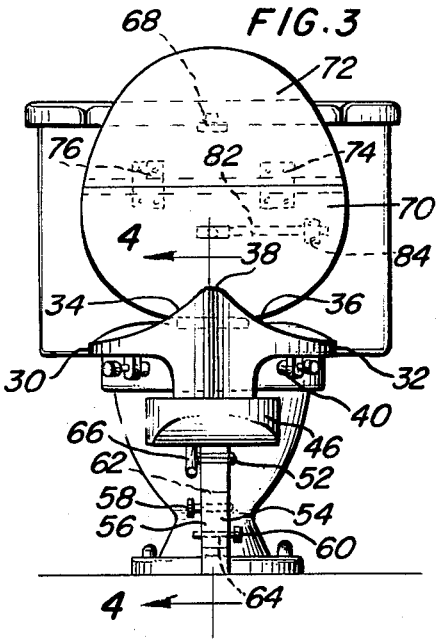
FIG. 3 is a front elevational view of the assemblage illustrated in FIGS. 1 and 2.

It will be noted from FIG. 2 of the drawings that the feet of the user 80 may rest upon the footrest portion 68 to facilitate the user 80 assuming a squatting position. Also, the concavity of the upper surface 24 of the seat member 22 more fully conforms to the lower contour of the user 80 when in a squatting position and the ridge 38 is received between the upper thigh portions of the user 80 to afford greater stability to the user.

The seat assembly 20 may be constructed of any suitable material such as plastic and the cover thereof is provided with a swingable locking lever 82 mounted on the section 70 and securable in an inactive position thereon by a clip 84. The lever 82 is swingable to an operative position for releasably securing the sections 70 and 72 in the coplanar positions thereof illustrated in FIG. 2 of the drawings and the section 72 includes a clip 86 engageable with the lever 82 in order to retain the lever 82 in the cover section locking position thereof.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. A toilet bowl assembly including an open seat member for use when seated during a bowel movement, said seat member defining an upper seat surface at least substantially encircling a vertical central opening extending through and defined by said seat member, said seat member including front, rear and opposite sides portions, said upper seat surface being upwardly concave in a front-to-rear extending direction, a cover, said cover including first and second sections pivotally joined together along adjacent marginal portions, the marginal portions of said first section opposite from said second section being pivotally supported relative to said seat member adjacent the rear portion thereof for swinging of said cover relative to the seat member between a raised upstanding position adjacent the rear portion of said seat member and a lowered horizontal position overlying and closing said seat member from above, said cover first and second sections being relatively angularly displaceable between coextensive generally coplanar positions to be assumed when the cover is disposed in the raised upstanding position thereof and relatively angulated positions with said first and second sections each inclined downwardly toward said adjacent marginal portions for fitting more closely over the upwardly concave upper surface of said seat member when said cover is disposed in the lowered horizontal position.

2. The combination of claim 1 wherein the portions of the upper seat surface on opposite sides of the central portion of the front portion thereof curve upwardly toward each other and define a rounded front-to-rear extending peak of said upper surface at said central portion of said front portion of said seat member upper surface.

3. The combination of claim 1 wherein said cover includes means operative to releasably retain said cover sections in said coplanar position.

4. The combination of claim 1 wherein said seat member includes a forward downwardly directed portion terminating downwardly in a forwardly directed horizontal footrest defining portion.

5. The combination of claim 4 wherein said footrest defining portion is pivotally supported from the lower end of said downwardly directed portion for upward swinging toward a retracted position.

6. The combination of claim 1 wherein said toilet bowl assembly includes an upwardly opening bowl member, said seat member being removably supported from and overlying the open upper end of said bowl member.

7. The combination of claim 6 wherein said seat member includes peripherally spaced downwardly projecting lugs between which the upper end of said bowl member is embracingly received.

8. The combination of claim 7 wherein said lugs include inwardly extending clamp screws threadedly supported therefrom and releasably clampingly engaging the upper bowl end therebetween.

9. The combination of claim 8 wherein said seat member includes a forward downwardly directed portion terminating downwardly in a forwardly directed horizontal footrest defining portion.

10. The combination of claim 9 wherein said footrest defining portion is pivotally supported from the lower end of said downwardly directed portion for upward swinging toward a retracted position.

11. The combination of claim 8 wherein said cover includes means operative to releasably retain said cover sections in said coplanar position.

12. The combination of claim 11 wherein said seat member includes a forward downwardly directed portion terminating downwardly in a forwardly directed horizontal footrest defining portion.

* * * * *